US005908326A

United States Patent [19]

Neuhauser et al.

[11] Patent Number: 5,908,326

[45] Date of Patent: Jun. 1, 1999

[54] ELECTRICAL CONNECTOR

[75] Inventors: Robert Neuhauser, Bruckberg; Rudolf Kraemer, Lautertal; Martin Franz Felix Maluche, Wormser; Werner Tille, Stockstadt, all of Germany

[73] Assignee: The Whitaker Corporation, Wilmington, Del.

[21] Appl. No.: 09/011,050

[22] PCT Filed: Aug. 13, 1996

[86] PCT No.: PCT/IB96/00796

§ 371 Date: Aug. 21, 1998

§ 102(e) Date: Aug. 21, 1998

[87] PCT Pub. No.: WO97/07562

PCT Pub. Date: Feb. 27, 1997

[30] Foreign Application Priority Data

Aug. 14, 1995 [DE] Germany ..... 195 29 893

[51] Int. Cl.[6] ..... H01R 4/24

[52] U.S. Cl. ..... 439/399; 439/398

[58] Field of Search ..... 439/397, 398, 439/399, 400, 401, 217

[56] References Cited

U.S. PATENT DOCUMENTS

| | | | |
|---|---|---|---|
| 4,277,124 | 7/1981 | Loose et al. | 439/398 |
| 4,472,596 | 9/1984 | Brown et al. | 174/84 C |
| 4,527,852 | 7/1985 | Dechelette | 439/398 |
| 4,660,917 | 4/1987 | DeRoss et al. | 439/404 |
| 4,834,670 | 5/1989 | Rodondi et al. | 439/398 |
| 4,840,578 | 6/1989 | Sato | 439/395 |
| 5,669,778 | 9/1997 | Kramer et al. | 439/398 |
| 5,820,402 | 10/1998 | Chiacchio et al. | 439/398 |

FOREIGN PATENT DOCUMENTS

| | | |
|---|---|---|
| 2 179 823 | 11/1973 | France . |
| 43 24 841-A1 | 1/1995 | Germany . |

OTHER PUBLICATIONS

See PCT International Search Report for references that are not enclosed herewith.

*Primary Examiner*—Neil Abrams
*Assistant Examiner*—Barry M. L. Standig

[57] ABSTRACT

The invention relates to an electrical connector with a housing (1) of insulating material and a metal contact element (2) fittable in the housing (1). The contact element has a crimp contact region (4) to contact a first cable end (11) and a cutting clamp contact region (3) to contact a second cable (12). Such an arrangement is not suitable for contacting cables of different diameters via the cutting clamp contact region. According to the invention, the cutting clamp contact region (3) has two tension-relieving regions (5, 6), with the cutting clamp blades, which are fitted opposite one another in pairs (7, 8, 9, 10), arranged between them. Two pairs of cutting clamp blades (7, 10) are provided for small-diameter cables and two pairs (8, 9) are provided for large-diameter cables. The pairs of cutting clamp blades (8, 9) for small-diameter cables are arranged between those for large-diameter cables.

6 Claims, 2 Drawing Sheets

ELECTRICAL CONNECTOR

BACKGROUND OF THE INVENTION

1. Field of the Invention

The invention relates to an electrical connector having a housing made of insulation material and a metallic contact element, which can be arranged in the housing and has an insulation-piercing contact region and a crimp contact region which, in the direction of the longitudinal axis of a cable that can be introduced, adjoins the insulation-piercing contact region and is conductively connected to it.

2. Summary of the Prior Art

There are many applications for which it is desirable to be able to use the insulation-piercing technique. However, one disadvantage of the insulation-piercing technique is that the contacts are very sensitive with respect to the diameter of the insulated conductors with which contact is to be made. However, since in the normal case it is to be assumed that it is not known from the beginning what cable size is intended to be connected using an insulation-piercing contact, this technique often cannot be used. The reason why insulation-piercing structures are so sensitive with respect to diameter fluctuations is that the cutter, which is intended to cut through the insulation, must reach the inner conductor.

DE 43 24 841 A1, which is representative of the prior art, has specified a method and a device for the power supply to optional, electrically-driven, special equipment devices, for example in a motor vehicle. For this purpose, a cable of a basic production cable set is connected by means of an electrical connector to a cable leading to the special equipment device. The electrical connector has a housing made of insulation material. Arranged in the housing is a contact element shaped from sheet metal and having an insulation-piercing contact region for the electrical cable and unitary with at least one further electrical connection region for making contact with at least one further electrical cable. The housing is divided into two chambers, one of which accommodates the insulation-piercing contact region and the other the further connection region. The two chambers are connected to each other via a passage, through which there passes a connecting web between the insulation-piercing contact region and the additional connection region. This citation does not reveal how an insulation-piercing structure can be used for cables with different diameters.

U.S. Pat. No. 4,472,596 likewise discloses the use of insulation-piercing structures. In this case, cables or cable ends are first fixed in a strain-relief region and contact is then made with them by means of an insulation-piercing structure. In each case, one pair of insulation-piercing structures is connected to each other and is surrounded on the outside by a pair of strain-relief regions.

U.S. Pat. No. 4,834,670 likewise discloses an electrical connector having an insulation-piercing contact region. This printed document discloses the construction of the insulation-piercing contact element in a U shape, two opposite insulation-piercing blades being arranged in each case on the limbs of the U.

SUMMARY OF THE INVENTION

It is the object of the invention to specify an electrical connector which has an insulation-piercing contact region and is suitable for cables with various diameters. The object is achieved by an electrical connector having the features of Patent claim 1. Advantageous developments are specified in the subclaims.

The electrical connector has, respectively, pairs of insulation-piercing blades for cables with a smaller diameter and for cables with a greater diameter. The pairs of mutually opposite insulation-piercing blades for cables with the larger diameter are in this case arranged on the outside, and the pairs of insulation-piercing blades for cables with a smaller diameter are arranged on the inside. If a cable of larger diameter is inserted into the insulation-piercing blades, contact is made by the outer insulation-piercing blades. In relation to the inner insulation-piercing blades, various possibilities can be conceived. Either the inner insulation-piercing blades cut not only into the outer insulation sleeve of the cable, but also into the inner conductor. However, this partial severing does not lead to further problems, since the cable is retained by the strain-relief regions, and mutual contact of the two cable parts is ensured by the outer insulation-piercing contacts and the base plate, connecting these, of the metallic contact element. Alternatively, the inner insulation-piercing blades are plastically deformed, since they are, for example, more easily deformable, since they are thinner than the outer insulation-piercing blades, and the thicker cable is not influenced by the inner insulation-piercing blades. It is also possible for the actual solution to lie between these two extremes.

It is particularly advantageous if the contact element can be pushed into a housing in the direction of the longitudinal axis of the cable that can be introduced. It is advantageous here if two latching positions are provided and, in a first initial latching position, a cable end can be introduced into the crimp contact region and, in a second end position, a cable can be introduced from above, through the housing, into the insulation-piercing contact region. The crimp contact region is thus protected against external influences and the entire contact element is also stabilized and protected by the housing.

In addition, it is advantageous that the insulation-piercing region and the crimp region are arranged in such a way that the two cables to be connected to each other are aligned with each other and are arranged in the housing one above the other in relation to the housing base. This ensures that the arrangement is implemented in a very compact manner and does not interfere further in the course of the continuous cable, since the cable end to be connected is aligned with the continuous cable.

In order to ensure reliable mounting of the cables, it is advantageous if the contact element and the housing have a stop for the initial latching position and the end position.

The electrical connector is suitable for connecting continuous cables of different sizes to one cable end, or for connecting two cable ends which are located opposite each other and have a larger diameter to a third cable end. The use of the electrical connector proceeds as follows: firstly, one cable end is introduced into the crimp contact region, and the crimp connection is closed. After this, the contact element with the first cable end is pushed into the housing. The second cable, a continuous cable, is then inserted from above, through the opening in the housing, into the insulation-piercing contact region. Depending on the size of the cable diameter, only the two inner pairs of insulation-piercing blades cut through the insulation of the cable and make contact with the conductor, or the two outer pairs of insulation-piercing blades and the two inner pairs of insulation-piercing blades cut through the insulation of the cable and the outer ones make contact with the conductor. The inner insulation-piercing blades then also partially cut through the conductor. In addition, after the cable has been introduced, the strain-relief elements of the strain-relief regions have to be closed. This can be performed, for example, through the opening of the housing, that is to say from above.

DETAILED DESCRIPTION OF THE PREFERRED EMBODIMENT

Figure 1:
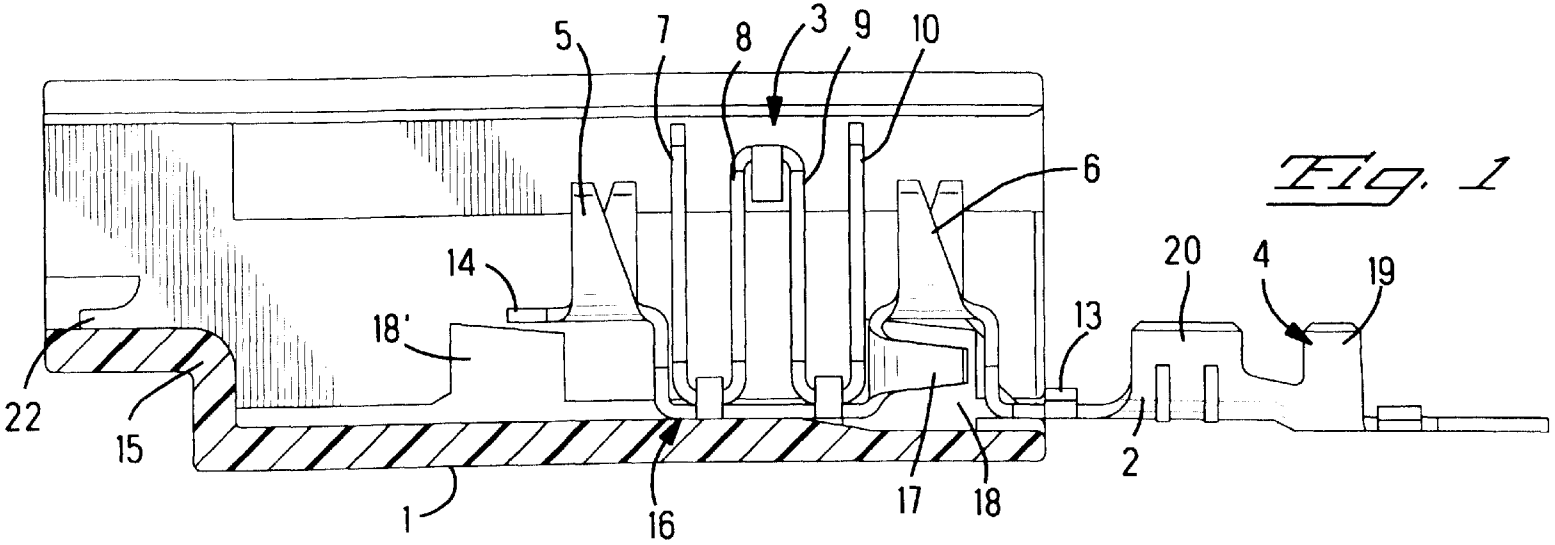
FIG. 1 shows a cross-section through a housing with an introduced contact element in the initial latching position.

An electrical connector is illustrated in FIG. 1. The housing 1 is essentially U-shaped. The opening of the U is located at the top in the drawing, the housing base 16 is illustrated in section at the bottom. A step 15 in the housing base 16 can be seen. The metallic contact element 2 is located on the lower level of the housing base 16. In FIG. 1, the said contact element 2 is only partially pushed in. The position illustrated in FIG. 1 is designated the initial latching position. A stop 13, which engages on a shoulder of the housing, prevents the further insertion of the contact element 2 into the housing 1. The withdrawal of the contact element 2 from the housing is prevented by two mutually opposite sprung elements 17 and corresponding broadenings in the housing cross-section 18, on which the spring elements 17 latch in.

In order to set up the metallic contact, the metallic contact element has an insulation-piercing contact region 3 and a crimp contact region 4. In the initial latching position of the contact element 2 in the housing 1, the insulation-piercing contact region 3 is already located in the housing, whereas the crimp contact region 4 is accessible outside the housing. Crimp contact region 4 and insulation-piercing contact region 3 are conductively connected to each other. The crimp contact region comprises two pairs of crimp blades arranged one behind the other, of which those 19 further remote from the insulation-piercing contact region 3 are used for fixing a cable end 11 having a cable sheath, and the crimp blades 20 arranged closer to the insulation-piercing contact region 3 are used for fixing the stripped conductors of the cable end 11.

The crimp contact region 4 is adjoined by the insulation-piercing contact region 3. Both regions are configured in such a way that cables 11,12 fixed herein are aligned with one another. In this case, the connected cables 11,12 lie one above the other in relation to the housing base 16. The insulation-piercing contact region 3 comprises the actual insulation-piercing blades 7 to 10 and two strain-relief regions 5 and 6. If the insulation-piercing contact region 3 is viewed in the direction of a cable that is to be inserted (see FIG. 3), then there are arranged, one behind another, a strain-relief region 5 with, for example, a pair of opposite tongues, which are crimped for the purpose of strain relief, a pair of opposite insulation-piercing blades 7, which are suitable for cables of a larger diameter, two pairs, arranged one behind the other, of insulation-piercing blades 8 and 9, which are arranged alongside each other and are suitable for cables of a smaller diameter, and a pair of insulation-piercing blades 10, which are arranged alongside each other and are once more suitable for cables of a larger diameter. The last element once more forms a strain-relief region 6 which, for example, may be composed of two opposite blades, which are to be crimped in order to fix the cable. The actual insulation-piercing contact region 3 is composed of a W profile with four planes, each of which has an opposite pair of insulation-piercing blades 7 to 10.

Figure 2:
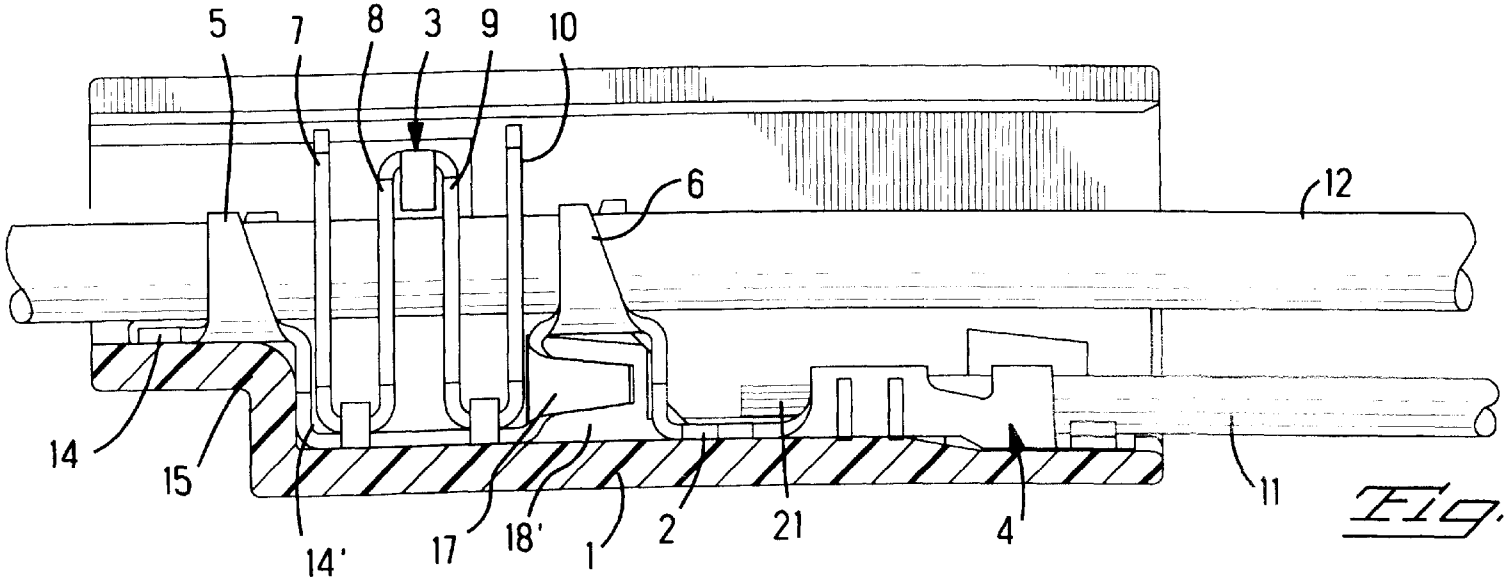
FIG. 2 shows a cross-section through a housing with a connected cable in an installation situation.

Illustrated in FIG. 2 is an arrangement according to FIG. 1 in an installation situation. In this case, a cable end 11 is fixed at the crimp contact region 4. The conductors 21 of the cable 11 can clearly be seen. They are retained by the crimp tab 20. It can also be seen that the stops 13 for the initial latching position are no longer visible. This results from the fact that, during the crimping operation, the stops are bent over at the same time, in order thus to make it possible for the contact element 2 to be inserted into the housing 1 in order to reach the end position. After the crimping operation, the metallic contact element 2 was pushed into the housing 1. At the same time, the sprung elements 17 are pushed further from a first taper in the cross-section of the housing 18 to a second taper in the cross-section of the housing at 18'. Provided on the contact element 2 is a stop 14' for the end position. The stop strikes on the step 15 in the housing 1. A projection 14 enters a depression, which is visible in FIG. 1, in the housing wall 22. This securing means is intended to prevent the arrangement being influenced by tension on the cable end that is on the left in the figure. In the end position, a second cable 12 can then also be introduced into the insulation-piercing contact region. The cable 12 is then conductively connected to the cable end 11.

Figure 3:
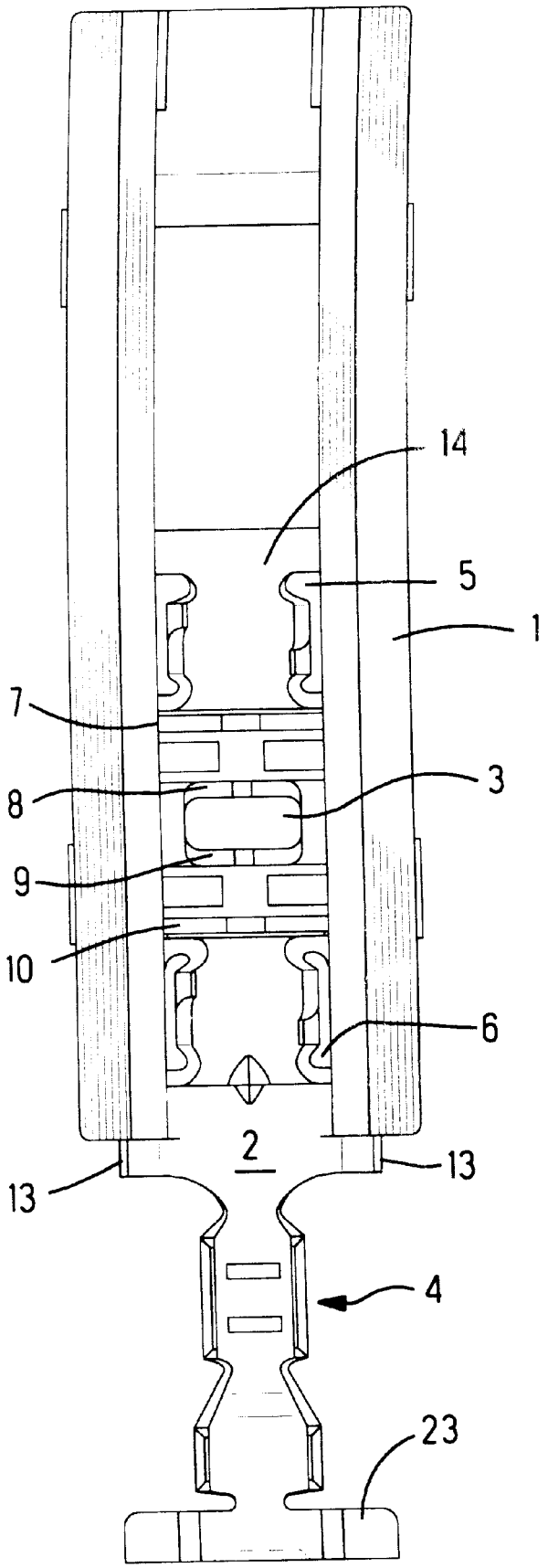
FIG. 3 shows a plan view of a housing with a contact element in the initial latching position.

The arrangement according to FIG. 1 is illustrated in a top view in FIG. 3. Identical reference symbols from FIGS. 1 and 3 have the same meaning. It can be seen that there is likewise provided, at the free end of the crimp contact region 4, a stop 23, which engages in a broadening in the housing 1, and this avoids the crimp contact region 4 being bent or even torn off the contact element in the event of tension on the cable end 11.

I/We claim:

1. An electrical connector comprising a housing and a metallic contact element, that is arranged in the housing and has an insulation-piercing contact region and a crimp contact region that, in the direction of the longitudinal axis of a cable that can be introduced, adjoins the insulation-piercing contact region and is conductively connected to it, the insulation-piercing contact region having two strain-relief regions, and insulation-piercing blades, which are opposite each other, being arranged between these crimp regions in two pairs, respectively of insulation-piercing blades being provided for cables of larger diameter and for cables of smaller diameter, in such a way that the pairs of insulation-piercing blades for cables of smaller diameter are arranged between those for cables of larger diameter.

2. Electrical connector according to claim 1, wherein the contact element can be pushed into the housing in the direction of the longitudinal axis of a cable that can be introduced in such a way that in an initial latching position a cable end can be connected to the crimp contact region, and in an end position at least one cable can be introduced from above into the housing, into the insulation-piercing contact region.

3. Electrical connector according to claim 1, wherein the arrangement of insulation-piercing and crimp region is implemented in such a way that the two cables are aligned with each other and are arranged in the housing one above the other in relation to the housing base.

4. Electrical connector according to claim 1, wherein contact element and housing have a stop for the initial latching position and the end position.

5. Electrical connector according to claim 1, wherein the insulation-piercing contact of the insulation-piercing contact region is composed of a W profile with four planes, each of which has an opposite pair of insulation-piercing blades.

6. Electrical connector according to claim 1, wherein the central insulation-piercing blades are plastically deformed by a thick cable.

* * * * *